US005575592A

United States Patent [19]

Pollack

[11] Patent Number: 5,575,592

[45] Date of Patent: Nov. 19, 1996

[54] TLP TENSION ADJUST SYSTEM

[75] Inventor: Jack Pollack, Camarillo, Calif.

[73] Assignee: Imodco, Inc., Calabasas Hills, Calif.

[21] Appl. No.: 355,552

[22] Filed: Dec. 14, 1994

[51] Int. Cl.[6] ..... B63B 35/44

[52] U.S. Cl. ..... 405/223.1; 114/265; 166/352; 405/224

[58] Field of Search ..... 405/223.1, 224, 405/224.2, 224.4; 114/265, 264; 166/352

[56] References Cited

U.S. PATENT DOCUMENTS

| | | | |
|---|---|---|---|
| 3,982,492 | 9/1976 | Steddum | 114/265 |
| 4,498,412 | 2/1985 | Liden | 114/264 |
| 4,850,744 | 7/1989 | Petty et al. | 114/265 |
| 4,861,196 | 8/1989 | Folse | 405/224 |
| 4,864,958 | 9/1989 | Belinsky | 114/265 |
| 4,938,632 | 7/1990 | Eie | 405/224 |
| 5,342,148 | 8/1994 | Huete et al. | 405/224 |
| 5,439,321 | 8/1995 | Hunter | 405/195.1 |

FOREIGN PATENT DOCUMENTS

| | | | |
|---|---|---|---|
| 2576577 | 8/1986 | France | 114/265 |
| 163793 | 8/1985 | Japan | 114/265 |
| 55287 | 3/1987 | Japan | 114/265 |
| WO93/06002 | 4/1993 | WIPO | 114/264 |

*Primary Examiner*—Hoang C. Dang
*Attorney, Agent, or Firm*—Freilich Hornbaker Rosen

[57] ABSTRACT

A tension leg platform system includes a relatively small platform (12, FIG. 3 ) and relatively low capacity tendons (16), despite providing sufficient tension to risers (34) that carry hydrocarbons from seafloor wells to the platform. With the platform floating at the sea surface and held in position by the tendons, seafloor wells can be connected through risers to a side of the platform, with the tension of each riser compensated by adding buoyancy to the corresponding side of the platform, as by using pressured air (at 100) to blow water out of a platform compartment (94).

3 Claims, 3 Drawing Sheets

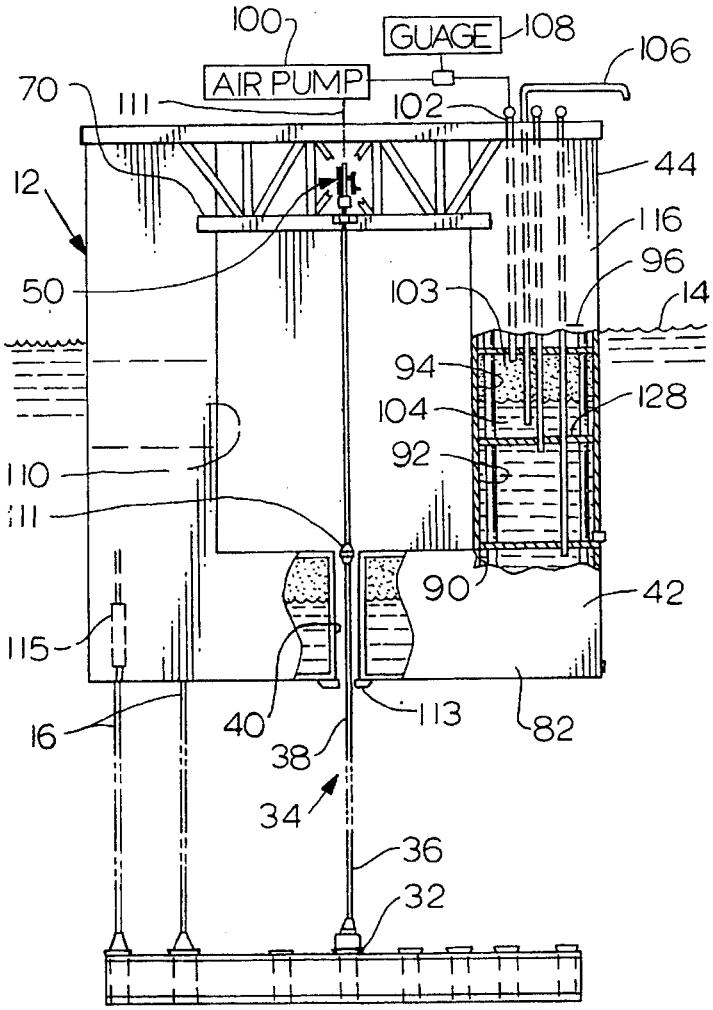
FIG. 3
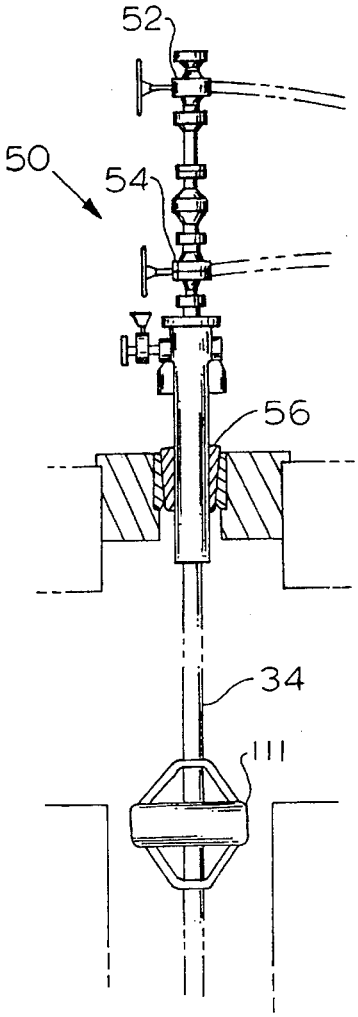
FIG. 4
FIG. 5
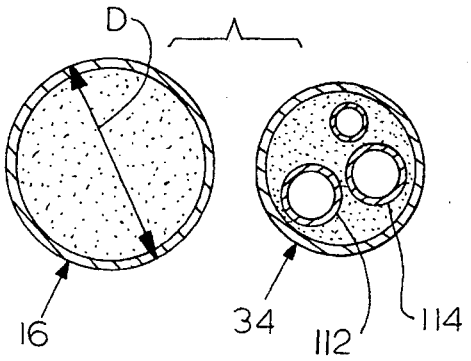

TLP TENSION ADJUST SYSTEM

BACKGROUND OF THE INVENTION

One method for developing and producing hydrocarbons from deep water oil fields, is to provide a fixed platform. Such fixed platforms may have drilling equipment as well as hydrocarbon processing equipment (e.g. to separate stones, sand, etc. from hydrocarbons, separate gas from oil, and burn or reinject gas). However, in deep waters such fixed platforms are enormously expensive, with costs sometimes exceeding one billion dollars.

A lower cost approach for developing and producing from deep undersea oil fields, involves the use of a TLP (tension leg platform). A large platform floats at the sea surface and is anchored by a group of tendons that extend vertically to the seafloor. The tendons are under high tension, produced by the large buoyant platform, which results in very little drift of the platform. As wells are drilled and fluid-carrying risers are connected between the seafloor well and the platform, such risers must be placed in tension to prevent them from repeatedly scraping against one another or a tendon. Present platforms are massive, with presently installed TLP's having a net displacement of between 20,000 tons and 300,000 tons (40,000 kips to 600,000 kips, where kips stands for thousands of pounds), with the tendons producing perhaps one-quarter of the platform displacement (e.g. 5,000 to 75,000 tons). The net weight of the platform out of the water may be at least 65% to 80% of the rest of the displacement. Such large TLP's carry substantially the same type of equipment as a fixed platform, including hydrocarbon processing equipment and permanent quarters for a crew to service the various equipment. Such TLP systems may include perhaps twenty wells, and perhaps twenty corresponding fluid-carrying risers which must be tensioned.

The tension for fluid-carrying hydrocarbon-producing risers may be perhaps 100 tons each, which is much less than 1% of prior total platform displacement (at least 20,000 tons). A complement of 20 risers results in an additional downward force of perhaps 2,000 tons on the platform of the TLP system, which is no more than 10% of the platform displacement. Such relatively small riser-caused load on a prior platform may be ignored, or may be taken by an initial slightly increased tendon load. Thus, when the risers are added, perhaps one at a time or in groups of a few, there is not much effect on the system, and the system need not be compensated as risers are added. However, such systems are still expensive (even though less than a fixed platform), and a system which was of much less cost than existing TLP systems, would be of considerable value.

SUMMARY OF THE INVENTION

In accordance with one embodiment of the present invention, a TLP (tension leg platform) system and method for installing risers in such system are provided, which enables the use of a TLP system of low cost. The platform has a relatively small displacement such as 6,000 tons, and is anchored with correspondingly lightweight tendons which apply a load such as 1,200 tons. As a result, the load applied by a full complement (e.g. 20) of risers is significant, as it may amount to perhaps 2,000 tons, which is more than 20% and usually more than 30% of the total platform displacement. Each riser may apply a load such as 100 tons, which is more than 1% of the total platform displacement. Applicant compensates for the load applied by each additional riser, by initially establishing the platform with flooded buoyancy chambers, and by adding buoyancy when each riser is attached, to compensate for the riser-added load. The platform may carry a drill/workover rig that can be moved to different locations. Buoyancy can be added to where the rig is moved and reduced from where the rig was moved, to avoid over and under tensioning of tendons and risers.

The novel features of the invention are set forth with particularity in the appended claims. The invention will be best understood from the following description when read in conjunction with the accompanying drawings.

BRIEF DESCRIPTION OF THE DRAWINGS

FIG. 3 is a partial section side view of the system of FIG. 1, showing how the buoyancy of the platform is changed.

FIG. 4 is an enlarged view of a portion of FIG. 3, showing a hydrocarbon production tree thereof.

FIG. 5 is a sectional view of a tendon and of a riser of the system of FIG. 1.

DESCRIPTION OF THE PREFERRED EMBODIMENT

Figure 1:
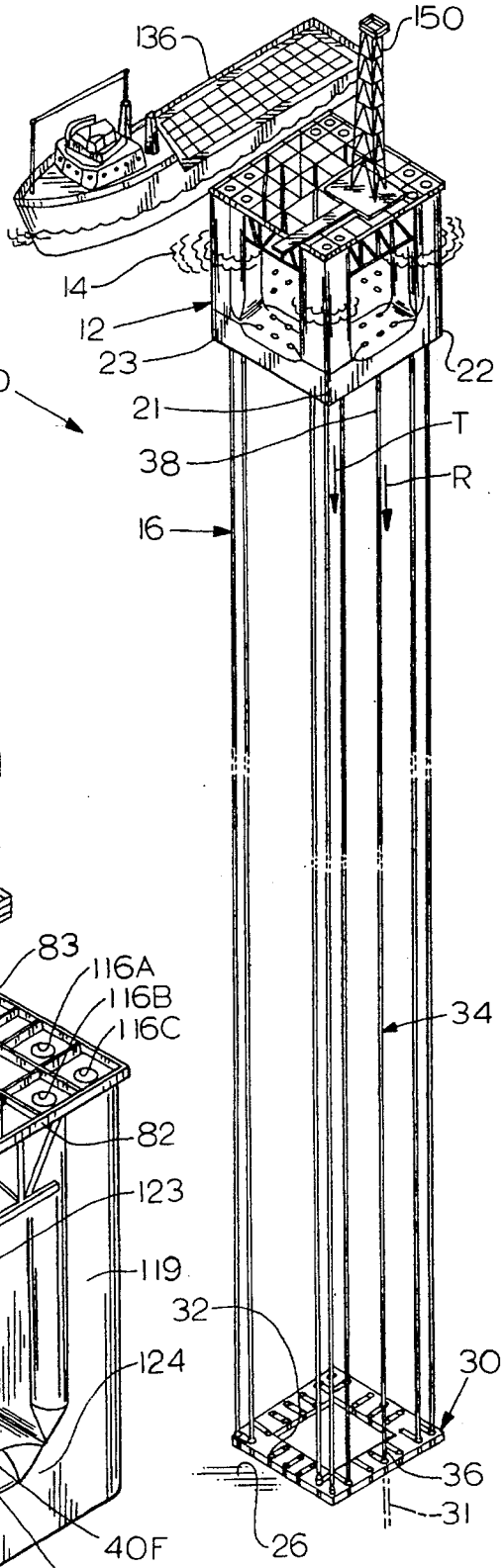
FIG. 1 is an isometric view of a TLP (tension leg platform) of the present invention, showing one of the risers being installed, and also showing a maintenance boat.

FIG. 1 illustrates a TLP (tension leg platform) system 10 which includes a platform 12 that floats at the sea surface 14 and which is anchored largely by groups of tendons 16. The tendons extend substantially vertically from each of four corners 21–24 of the platform down to the seafloor 26. The tendons are connected to a template 30 that is anchored to the seafloor. The particular system includes twelve tendons arranged in groups of three at each of the corners of the platform and of the template. The template has wellhead couplings 32 arranged at the sides of the square template 30, to which risers such as 34 are connected. The system is initially setup as shown in FIG. 1, with only the tendons 16 extending down to the seafloor. Wells 31 may be drilled in the seafloor through the wellhead couplings 32, and risers such as riser 34 are then installed, which have lower ends 36 connected to the seafloor at the template 30, and upper ends 38 coupled to the platform. Both the platform and template are of substantially rectangular shape as seen in a plan view.

As shown in FIG. 3, the upper end 38 of the riser 34 extends through an aperture 40 in the lower portion 42 of the platform, through the water line or sea surface 14, and to an upper part 44 of the platform which lies above the sea surface. A hydrocarbon production tree 50 is mounted on the upper portion 44 of the platform to lie above the sea surface. As shown in applicant's FIG. 4, the tree 50 has various valves such as 52, 54 and pipe couplings, where well effluent can be removed for processing, and through which gas might be reinjected, control signals (in the form of fluid pulses) can be delivered to downhole equipment to operate a valve thereat, etc.

It is important that the risers 34 and tendons 16 be kept under a substantial tension, so they cannot whip about and strike one another. Tension in the risers is established by a rig 150 (FIG. 1). After a riser is tensioned, a stopper 56 (FIG. 4) thereafter maintains the tension. The tendons are tensioned by deballasting the TLP (by pumping air into water-filled chambers) when the TLP system is initially installed.

Applicant constructs the platform 12 (FIG. 1) so it is of relatively light weight and correspondingly small displacement, with the particular platform shown being designed for a working displacement of 6,000 tons (12,000 kips or thousands of pounds). Thus, the term "working displacement" means the weight of water that is displaced by the platform in use. Applicant uses tendons 16 which are of relative low tension capacity, with their preferred tension under quiescent conditions being about 150 tons each. The result is that the total quiescent downward force of the twelve tendons is about 1,800 tons. The riser tension is considerable as compared to platform displacement and tendon total tension, in that total riser tension (of twenty risers) is more than 20% of platform displacement, and more than 20% of total tendon tensions, so the tension in each riser is at least 1% of platform displacement and total tendon tension.

With each riser 34 being designed for a quiescent tension of 100 tons, the total tension applied by all twenty risers would be about 2,000 tons, which is a very significant portion (about one-third) of the total downward force of 6,000 tons on the platform 12. The total downward force of 6,000 tons on the platform may include a total weight of the platform in air, of 2,200 tons, plus 1,800 tons in tendon tension, plus 2,000 tons of riser tension (when all 20 risers are installed). Thus, the downward force that would be applied by all risers (of 2000 tons) is at least about equal to the downward force (of 1800 tons) applied by all of the tendons. The platform may have a width, length, and height, that are each about 30 meters, and is designed for installation in a deep sea (usually a plurality of hundreds of meters) that may have a depth on the order of 1,000 meters. Under severe storm conditions, the tendon tension may more than double to 300 tons or more per tendon.

Although the system shown in FIG. 1 can produce from up to twenty wells, it is common to drill and install only one or a few wells at a time, and to operate the system for an extended period before additional wells are added (if ever, depending on production rates achieved and other matters). As mentioned above, the additional downward load on the platform 12, that is added when each riser is installed, is substantial (over 1% of total platform displacement). If a group of risers are added, which each apply a load of 100 tons on the platform, this will result in a corresponding decrease in loading of the tendons and existing risers. When starting with no risers, the addition of a riser would result in undertensioning (e.g. from 150 tons to 142 tons for one riser and to 100 tons for 6 risers) of the tendons so the tendons may repeatedly go slack and cause riser failure in a storm. It would be possible to retension the tendons whenever a group of risers were installed, but retensioning is time consuming and costly. Also, whenever a new group of risers were added, the old risers as well as all tendons would have to be retensioned, which would be very time consuming. It is noted that if one or a few risers were attached to only one of the four sides 81–84 (FIG. 2) of a platform, more tension would have to be added to the tendons on the same side of the platform as the risers. The wide variation in downward load on the platform, between a situation where only one or a few risers were connected as compared to a situation where all twenty risers were connected, also would result in some change in depth of submersion of the platform.

Because of the light weight of the tendons, it is not practical to initially overtension them, so that when risers were added the tendon tensions would drop close to the ideal. That is because overtensioned tendons might fail. For example, in order for the twelve tendons to return to a quiescent tension of a total of 1,440 tons, or 120 tons each (only 20% below the ideal of 150 tons) after all twenty risers were installed, the tendons would have to be initially set at a tension of 287 tons each (a total of about 3,440 tons which is 91% over the ideal) and would be overtensioned in event of a storm. In a small prior art platform of 20,000 tons displacement, with an ideal tendon tension of 10,000 tons, the tendons could be initially tensioned at 11,000 tons (10% over ideal). When twenty risers (2,000 tons total tension) were added, the net tendon tension would fall to only 9,000 tons (10% below ideal). 90% of ideal tension does not substantially affect performance.

In accordance with an aspect of the invention, applicant changes the buoyancy of the platform 12 whenever a group of risers are added. As shown in FIG. 3, the TLP is provided with multiple buoyancy chambers such as 90, 92, and 94, which may be initially flooded with water, so that an imaginary water line 96 on the platform lies at sea level 14 when all tendons are attached and properly tensioned, but no riser has been installed. When a group of risers (which includes one or more risers) is installed and tensioned, and the platform tends to move down in the water (and the tendon tension tends to decrease) applicant adds buoyancy to the platform. (It is noted that the buoyancy can be added before or even during riser tensioning.) An air pump 100 pumps air (or other gas such as nitrogen) through a valve and pipe 102 to one of the buoyancy chambers 94. The compressed air at 103 in the chamber, causes water 104 in the chamber to be expelled through a vertical pipe 106 into the sea. Thus, all chamber connections are above water level, even for chambers that lie completely underwater, which assures that a chamber will not be flooded if a valve malfunctions. The water level in the chamber is recorded by a calibrated pressure gauge 108. Air is pumped until the weight of expelled water approximately equals the tension load (e.g. 100 tons) added to the platform by the properly tensioned riser. As a result of the buoyancy adjustment, the level of platform submersion will remain constant and the tension in the tendons will remain constant. Thus, no retensioning of the tendons is required and the platform remains at a constant desired level of submersion which will keep the trees 50 above water (for easy servicing) while maintaining only a moderate profile for low wave response.

The pump 100 is preferably brought to the platform on a relatively small boat by a crew that is not quartered on the platform (although a temporary emergency shelter can be provided). The boat also can bring the rig to the platform. By avoiding permanent quarters (beds, cooking and entertainment facilities, etc.), the platform can be made relatively small and cheap.

Since one or a few risers may be added to only one side of the platform, applicant prefers to add buoyancy to only that side of the platform to maintain a more constant tendon tension. Accordingly, applicant may add buoyancy to a pair of chambers 94, 110 which lie at opposite ends of the same side 82 of the platform. The platform includes numerous chamber spaced about the axis 109 of the platform, including a plurality of completely underwater chambers stacked one on another. This facilitates compensation for riser tension that avoids tilt of the platform.

Figure 2:
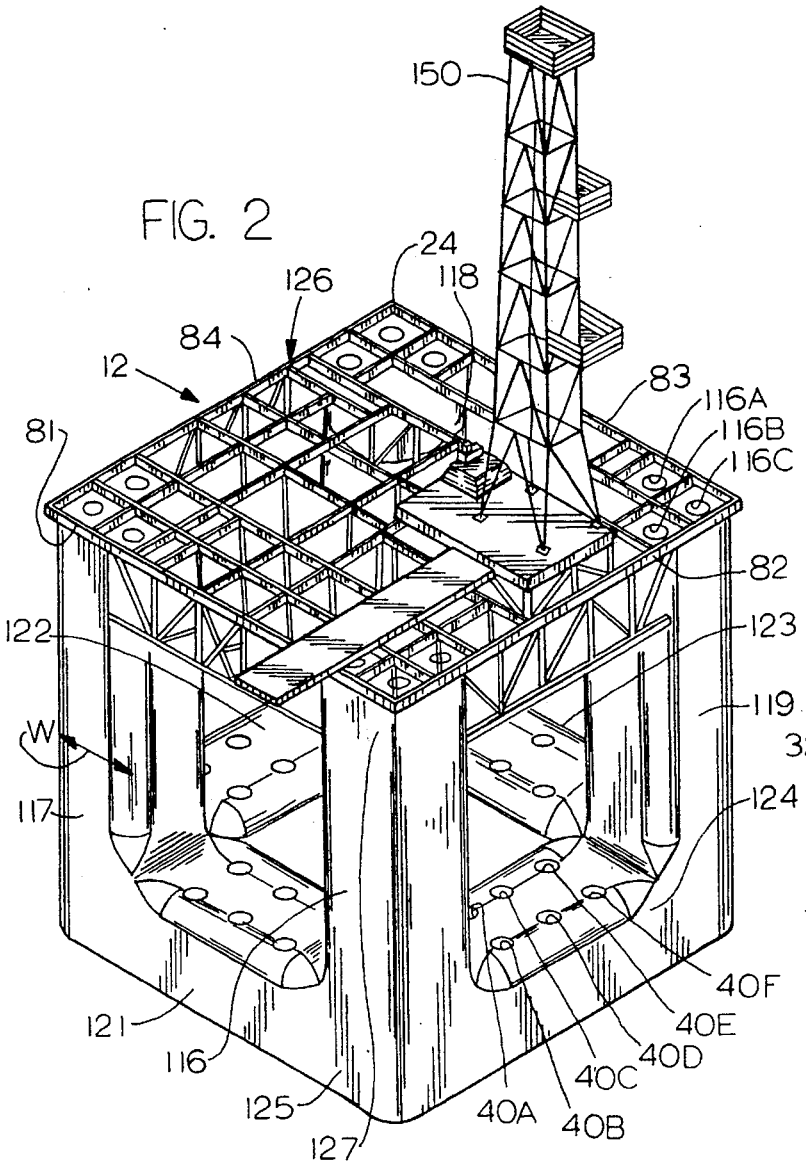
FIG. 2 is an isometric view of the platform of the system of FIG. 1.

FIG. 2 shows that the particular platform 12 has six apertures such as 40A–40F at each side such as 82. A maximum of five is used, with the sixth used if one of the others cannot be used. The platform has three apertures such as 116A–116C at each corner such as 22, where tendons will lie.

FIG. 5 is a sectional view of one tendon 16 and of one riser 34. A common tendon size has an outside diameter D of 13 inches while a common riser size has an outside diameter of 9⅝ inch. One or several fluid-carrying pipes such as 112, 114 may lie within the riser 34 to actually carry fluid. The rest of the inside of the riser normally contains air or nitrogen, as does the inside of the tendon 16, to provide buoyancy that counteracts the weight of the steel. Although prior risers might be of the same diameter as riser 34, prior tendons used in TLP systems were typically of greater diameter than risers 16 and/or more of them were used.

In FIG. 3, the riser 34 bends about the bottom of the tree for up to 0.8° of platform deviation from its quiescent position. Between 0.8° and 5° of deviation, an upper crossload bearing 111 presses against the walls of aperture 40, and riser bending occurs immediately below bearing 111. Between 5° and maximum deviation (perhaps 8° in a severe storm), riser bending occurs at a lower crossload bearing 113. The tendons each bend about a joint 115 that is also at the bottom of the platform, so the tendons and risers remain parallel for large platform drift.

The tendon 16 of FIG. 5 of diameter D of 13 inches has a cross-sectional area of steel of 17.3 inches$^2$, while the riser 34 of 9⅝ inch diameter has a cross-sectional area of steel of 11.45 inches$^2$. It is desirable to maintain the steel in each tendon and riser at the same unit tension stress level, of about 19,200 psi. For a sea depth of 1,000 meters, such equal stress (per unit cross-sectional area) results in an elongation of 2.2 feet for each. Applicant prefers to maintain the strain (elongation) and therefore the stress per unit area, of the tendons and risers within 20% of each other, and more preferably within about 10% of each other in the quiescent position of the platform, so the strain is about equal under severe storm conditions and the mooring load is shared by tendons and risers.

As shown in FIG. 2, the platform 12 includes four vertically extending corner columns 116, 117, 118 and 119 lying at the corners of an imaginary rectangle (which is preferably substantially a square). Four horizontal beams 121, 122, 123 and 124 each connect the lower ends 125 of a different pair of columns. Each of the columns and beams 116–119 and 121–124 has an average width W of a plurality of feet (e.g. 7 meters), with the particular columns and beams shown having an average width of over one meter, and all form at least one chamber which can hold water or air to change the ballast condition of the platform. A beam structure 126 comprising multiple steel beams (none forms a hollow water-filled chamber), connects the upper ends 127 of the columns. Each column such as column 116 shown in FIG. 3 has a plurality of vertically spaced chambers with a horizontal separating wall 128. The separating wall is part of the column structure. The use of a plurality of vertically-spaced columns avoids large platform tilt if one of the chambers develops a leak.

Figure 6:
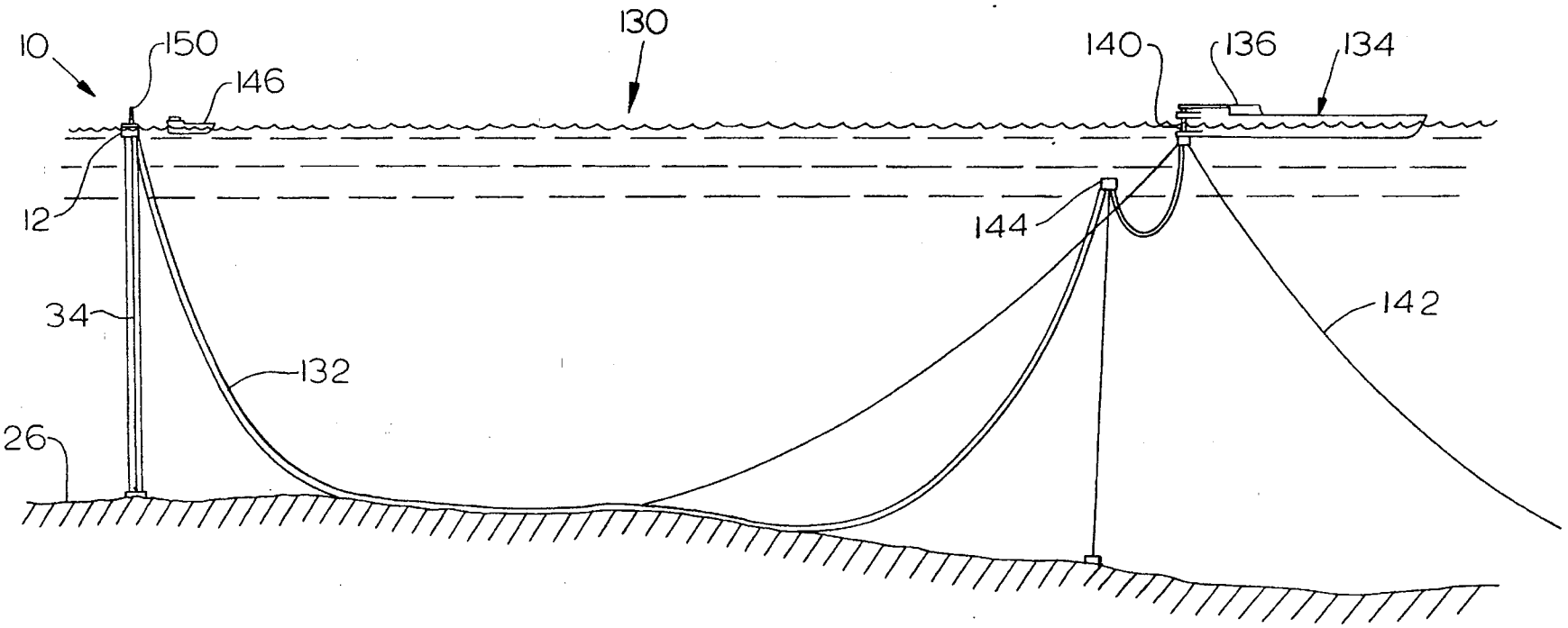
FIG. 6 is a side elevation view of an oil production complex which includes the system of FIG. 1.

FIG. 6 shows an oil production complex 130 which includes the system 10 of FIG. 1. Oil passing up through the risers 34 and into the trees on the platform 12, is gathered and passed through pipes lying within a conduit 132 that extends to a large vessel 134. The large vessel 134 may be a tanker with large oil-storing capacity, and which also has hydrocarbon processing equipment 136, permanent (non-emergency crew quarters where personnel stay for many days under normal operating conditions), offloading equipment for transferring oil to other tankers, life boats, etc. If the platform has any hydrocarbon processing equipment, it is minimal in that the mass of processing equipment on the vessel is at last 5 times as great. The vessel supports a turret 140 that can remain stationary (not rotate much, but only drift) while the vessel weathervanes around it, and the vessel is moored by catenary anchor chains 142. The anchor chains allow the vessel to drift only a moderate amount such as 300 meters. The platform 12 lies in water having a depth of 1,000 meters and the space between the vessel 134 and platform is at least 500 meters. It is noted that the fluid conduit 132 includes two sections, with a buoy 144 connecting them.

Systems for anchoring large vessels such as 134 while allowing them to drift, are of only moderate cost. Applicant's TLP system 10 is of relatively small size, so it is also of moderate cost. Servicing of the platform 12 is done by relatively small boats 146 carried by crew members stationed on the vessel 134. Such crew members may carry air pumps and various equipment for maintaining parts of the system 10, and also serve to operate a tender assisted workover rig 150 which can carry out well completion, workover and redrilling. The rig 150 can be shifted around the TLP on skids, which is well known to the industry. For some systems, it is possible to remove the rig when a storm approaches. By minimizing equipment on the fixed platform 12, where the cost for the platform and anchoring equipment is relatively high, and placing such equipment on the weathervaning vessel 134 where the cost of supporting such equipment is relatively small (especially because it is already large enough to store oil), applicant minimizes the cost of the entire complex 136. Of course, in some installations, the conduit 134 can extend to shore and the crew is quartered on shore.

The rig 150 has considerable weight (e.g. 400 tons, which is at least 5% of tendon and riser tension). As a result, when the rig is moved from a first location on the platform to a primarily horizontally spaced second location, such movement could overtension tendons and risers whose upper ends lie near the first location and undertension tendons and risers at the second location. Applicant compensates for the change in center of gravity (and center of buoyancy) caused by such movement by reducing buoyancy at the previous rig location (by admitting water into buoyancy chambers near the previous rig location) and/or by adding buoyancy at the new rig location (by removing water from buoyancy chambers near the new rig location). This is because tension elements (tendons and any already-installed risers) are spaced about the platform axis 152, and such compensation minimizes changes in tension of such tension elements due to such rig movement.

Thus, applicant provides a relatively low cost TLP system. This is accomplished by using a relatively small platform and relatively light duty tendons that hold it in place, together with moderately large risers (requiring moderately large tension) which may be connected singly or in small groups, with the system designed to operate for indefinite periods and even in storms, between riser additions. The platform is provided with buoyancy adjusting means in the form of chambers which are initially flooded but which can be partially or completely filled with gas instead of water to increase platform buoyancy. Such ability to increase platform buoyancy in steps, allows applicant to easily adjust for the additional tension produced by the addition of each riser. This allows for the use of a relatively light weight platform and relatively light weight tendons, which greatly reduces the cost of the system. The light weight platform preferably has only minimal equipment, including a tree for each riser, possibly a mount for holding a derrick, and minimal couplings and piping.

Although particular embodiments of the invention have been described and illustrated herein, it is recognized that modifications and variations may readily occur to those skilled in the art, and consequently, it is intended that the claims be interpreted to cover such modifications and equivalents.

I claim:

1. A hydrocarbon production complex comprising:

a platform that floats at the sea surface;

a plurality of risers and tendons each extending down from said platform to the seafloor;

a vessel having a working displacement which is a plurality of times greater than the working displacement of said platform, said vessel lying at least about 500 meters away from said platform, and anchored so it can drift and weathervane;

said platform includes at least one tree connected to upper ends of said risers;

a fluid conduit extending primarily downwardly from said tree on said platform to the seafloor, along said seafloor, and generally upwardly from the seafloor to said vessel;

said platform is substantially devoid of well effluent processing equipment, but said vessel has well effluent processing equipment of a mass more than five times any processing equipment on said platform.

2. A tension leg platform system which includes a platform that floats at the sea surface and a plurality of tendons extending down from said platform to the seafloor and anchored thereto, said platform having means for attaching up to a predetermined maximum number of risers, and including a plurality of risers each extending down from said platform to the seafloor and anchored thereto, with said tendons and risers each being held under tension which produces downward forces on said platform that are countered by displacement of said platform, wherein:

said platform has a small enough buoyancy and said tendons have a small enough tension, that the combined downward force that would be applied by said predetermined number of risers to said platform is at least 20% of the total working displacement of said platform;

said platform has means for varying the buoyancy of said platform in water to compensate for the tension of risers that are attached to said platform after said tendons are attached, so as to maintain approximately constant tendon tension, whereby to avoid the need for repeated tendon adjustment.

3. A tension leg platform system comprising:

a platform that floats at the sea surface;

a plurality of tendons extending down from said platform to the seafloor and anchored thereto;

said platform having means for attaching up to a predetermined number of risers that are of substantially a predetermined size and that each extends down from said platform to the seafloor and is anchored thereto, with said tendons and risers each being held under tension which produces approximately equal tension per unit area in all tendons and risers;

said platform has a small enough buoyancy and said tendons have a small enough tension, that the combined downward force that would be applied by said predetermined number of risers to said platform is at least about equal to the downward force applied by all of said tendons to said platform;

said platform has means for varying the buoyancy of said platform in water to compensate for the tension of risers that are attached to said platform after said tendons are attached, so as to maintain approximately constant tendon tension, whereby to avoid the need for repeated adjustment of tendon tension or the need for large tendons that are of large cross-section and that carry very large tension loads.

* * * * *